US010024287B2

(12) United States Patent
Grandi et al.

(10) Patent No.: US 10,024,287 B2
(45) Date of Patent: Jul. 17, 2018

(54) VALVE BODY AND FLUID INJECTOR

(71) Applicant: Continental Automotive GmbH, Hannover (DE)

(72) Inventors: Mauro Grandi, Leghorn (IT); Francesco Lenzi, Leghorn (IT); Valerio Polidori, Leghorn (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/773,544

(22) PCT Filed: Feb. 17, 2014

(86) PCT No.: PCT/EP2014/052996

§ 371 (c)(1),
(2) Date: Sep. 8, 2015

(87) PCT Pub. No.: WO2014/135359

PCT Pub. Date: Sep. 12, 2014

(65) Prior Publication Data

US 2016/0017853 A1 Jan. 21, 2016

(30) Foreign Application Priority Data

Mar. 7, 2013 (EP) ..... 13158171

(51) Int. Cl.
*F02M 61/00* (2006.01)
*F02M 51/06* (2006.01)
(Continued)

(52) U.S. Cl.
CPC ..... *F02M 61/10* (2013.01); *F02M 51/0614* (2013.01); *F02M 51/0667* (2013.01);
(Continued)

(58) Field of Classification Search
CPC ..... F02M 61/10; F02M 51/0664; F02M 51/0667; F02M 2200/8061; F02M 61/168;
(Continued)

(56) References Cited

U.S. PATENT DOCUMENTS 4,880,206 A * 11/1989 Lungu ..... B60H 1/00485 251/129.21
4,967,966 A 11/1990 Babitzka et al. ..... 239/585.4
(Continued)

FOREIGN PATENT DOCUMENTS

DE 3905992 A1 9/1989 ..... F02M 45/08
DE 102005032379 A1 1/2007 ..... B60R 25/00
(Continued)

OTHER PUBLICATIONS

German Office Action, Application No. 102015205040.8, 9 pages, dated Nov. 5, 2015.
(Continued)

*Primary Examiner* — Alexander Valvis
(74) *Attorney, Agent, or Firm* — Slayden Grubert Beard PLLC

(57) ABSTRACT

A valve body for a fluid injector includes a central longitudinal axis and a one-piece base body. The base body has a side wall defining a recess extending from a fluid inlet side to a fluid outlet side of the base body. The side wall has a thin portion having a decreased wall thickness relative to further portions of the side wall that adjoin the thin portion along the longitudinal direction towards the fluid inlet side and the fluid outlet side. The valve body includes a metallic reinforcement jacket that is rigidly coupled to the base body and which axially overlaps the thin portion having the decreased wall thickness.

13 Claims, 3 Drawing Sheets

(51) Int. Cl.

| | |
|---|---|
| ***F02M 61/10*** | (2006.01) |
| ***F02M 61/16*** | (2006.01) |
| ***H01F 7/08*** | (2006.01) |
| ***H01F 7/16*** | (2006.01) |
| ***F02M 63/00*** | (2006.01) |

(52) U.S. Cl.
CPC ..... *F02M 51/0682* (2013.01); *F02M 61/168* (2013.01); *F02M 63/0021* (2013.01); *F02M 63/0078* (2013.01); *H01F 7/081* (2013.01); *H01F 7/1607* (2013.01); *F02M 2200/08* (2013.01); *F02M 2200/8061* (2013.01); *F02M 2200/9069* (2013.01)

(58) Field of Classification Search
CPC ... F02M 2200/8015; F02M 2200/9069; F02M 2200/9076; F02M 2200/07; F02M 2200/08; F02M 51/0682; F16K 31/0651
See application file for complete search history.

(56) References Cited

U.S. PATENT DOCUMENTS

| | | | | |
|---|---|---|---|---|
| 5,127,585 | A | 7/1992 | Mesenich | 239/585.5 |
| 5,769,391 | A * | 6/1998 | Noller | F02M 51/061 239/585.4 |
| 6,229,494 | B1 | 5/2001 | Merenda | 343/741 |
| 6,273,032 | B1 * | 8/2001 | Ruoff | F02B 47/02 123/25 R |
| 7,028,918 | B2 * | 4/2006 | Buchanan | F02M 61/14 239/132 |
| 8,245,394 | B2 | 8/2012 | Seitter et al. | 29/851 |
| 2003/0189183 | A1 * | 10/2003 | Noller | F02M 51/0614 251/129.21 |
| 2009/0261946 | A1 | 10/2009 | Tenconi | 340/5.72 |
| 2012/0092043 | A1 | 4/2012 | Nierop et al. | 327/109 |
| 2014/0166120 | A1 * | 6/2014 | Filippi | F02M 51/0614 137/15.18 |

FOREIGN PATENT DOCUMENTS

| | | | | |
|---|---|---|---|---|
| DE | 102006055010 | A1 | 5/2008 | F16K 31/06 |
| DE | 102013220596 | A1 | 4/2015 | G01R 19/00 |
| DE | 102014222603 | B3 | 12/2015 | B60R 25/00 |
| EP | 0352445 | A1 | 1/1990 | F02M 51/00 |
| EP | 871037 | A1 | 10/1998 | G01R 17/16 |
| EP | 2339596 | A1 | 6/2011 | F02M 51/06 |

OTHER PUBLICATIONS

European Search Report, Application No. 13158171.2, 5 pages, dated May 21, 2013.
International Search Report and Written Opinion, Application No. PCT/EP2014/052996, 8 pages, Apr. 10, 2014.
Korean Office Action, Application No. 1020157027824, 13 pages, dated Jan. 6, 2017.
Chinese Office Action, Application No. 201480012727.X, 13 pages, dated Dec. 30, 2016.

* cited by examiner

VALVE BODY AND FLUID INJECTOR

CROSS-REFERENCE TO RELATED APPLICATIONS

This application is a U.S. National Stage Application of International Application No. PCT/EP2014/052996 filed Feb. 17, 2014, which designates the United States of America, and claims priority to EP Application No. 13158171.2 filed Mar. 7, 2013, the contents of which are hereby incorporated by reference in their entirety.

TECHNICAL FIELD

The present disclosure relates to a valve body for a fluid injector having a central longitudinal axis and comprising a base body. Furthermore, the invention relates to a fluid injector such as a fuel injector for an internal combustion engine of a motor vehicle.

BACKGROUND

Fuel injectors, often referred to as injection valves (gasoline injectors) or injection nozzles (diesel injectors), are widely used, particularly for internal combustion engines in which they are arranged in order to dose fuel into an intake manifold of the internal combustion engine, or directly into a combustion chamber of a cylinder of the internal combustion engine. In order to enhance a combustion process in view of creation of unwanted emissions, the respective injector is suited to dose the fuel under comparatively high pressures. In case of a gasoline engine, the pressures may for example be in the range of up to over 200 bar, and in the case of diesel engines, for example in the range of up to over 2.500 bar.

Fuel injectors are manufactured in various forms in order to satisfy the needs for various combustion engines. Injection valves or injection nozzles accommodate an actuator for actuating a valve needle or nozzle needle of the fuel injector, respectively. Such an actuator is for example an electromagnetic actuator.—Fuel injectors with a ferromagnetic valve body or a ferromagnetic nozzle body undergo a magnetic flux bypass through a wall of the ferromagnetic body (cf. FIG. 2). Such a parasitic secondary magnetic flux causes a general deterioration of the dynamic responses of the respective fuel injector, i.e. the injection valve or the injection nozzle.

The secondary magnetic flux through the valve or nozzle body may be reduced by using a paramagnetic base body. However, the paramagnetic valve, nozzle or injector body reduces the overall efficiency of a magnetic circuit of an electromagnetic actuator of the respective injector, and therefore worsens the dynamic responses of the injector, in particular because it introduces a comparatively wide gap between an armature and a housing (yoke) of the actuator, as well as a pole piece and a washer (yoke) of the actuator (cf. FIG. 2).

SUMMARY

One embodiment provides a valve body for a fluid injector having a central longitudinal axis and comprising a one-pieced base body, the one-pieced base body having a side wall defining a recess extending from a fluid inlet end to a fluid outlet end of the valve body, wherein the side wall has a thin portion, the thin portion having a decreased wall thickness relative to further portions of the side wall which adjoin the thin portion in longitudinal direction towards the fluid inlet side and the fluid outlet side, respectively, and the valve body comprises a metallic reinforcement jacket which is rigidly coupled to the base body and axially overlaps the thin portion having the decreased wall thickness.

In a further embodiment, the decreased wall thickness of the thin portion results from a circumferential groove in the base body.

In a further embodiment, the groove is comprised by an inner circumferential surface of the side wall and the reinforcement jacket adjoins an outer circumferential surface of the side wall.

In a further embodiment, the reinforcement jacket is hooped, press-fitted and/or welded to the base body.

In a further embodiment, the dimensions of the reinforcement jacket are chosen in such a way that the reinforcement jacket exerts compressive mechanical stress on the base body in radially inward direction.

In a further embodiment, the reinforcement jacket covers the thin portion over a full longitudinal extension of the thin portion.

In a further embodiment, the reinforcement jacket projects beyond the thin portion in longitudinal direction towards the fluid inlet side and/or towards the fluid outlet side.

In a further embodiment, the thin portion is positioned in a longitudinal middle section of the reinforcement jacket or in a longitudinal end section of the reinforcement jacket, which faces the outlet or inlet side of the base body.

In a further embodiment, the reinforcement jacket is made from a paramagnetic or a non-magnetic material and the base body is at least partially made from a ferromagnetic material.

Another embodiment provides a fluid injector comprising a valve body as disclosed above.

In a further embodiment, the fluid injector further comprises an electromagnetic actuator assembly comprising an electromagnetic coil, wherein a bobbin provided with the electromagnetic coil is mounted outside of the valve body, wherein the reinforcement jacket is provided between the base body and the bobbin.

In a further embodiment, at a longitudinal end of the reinforcement jacket, the bobbin is distanced from the base body in longitudinal direction.

In a further embodiment, the electromagnetic actuator assembly forms an electromagnetic circuit comprising the base body, the electromagnetic coil, and an armature, the armature being moveable in a reciprocating manner in the base body, and—a pole piece.

In a further embodiment, the reinforcement jacket axially overlaps with the armature and/or with the pole piece.

BRIEF DESCRIPTION OF THE DRAWINGS

Example embodiments of the valve body and the fluid injector are discussed below with reference to the figures, in which.

DETAILED DESCRIPTION

Figure 1:
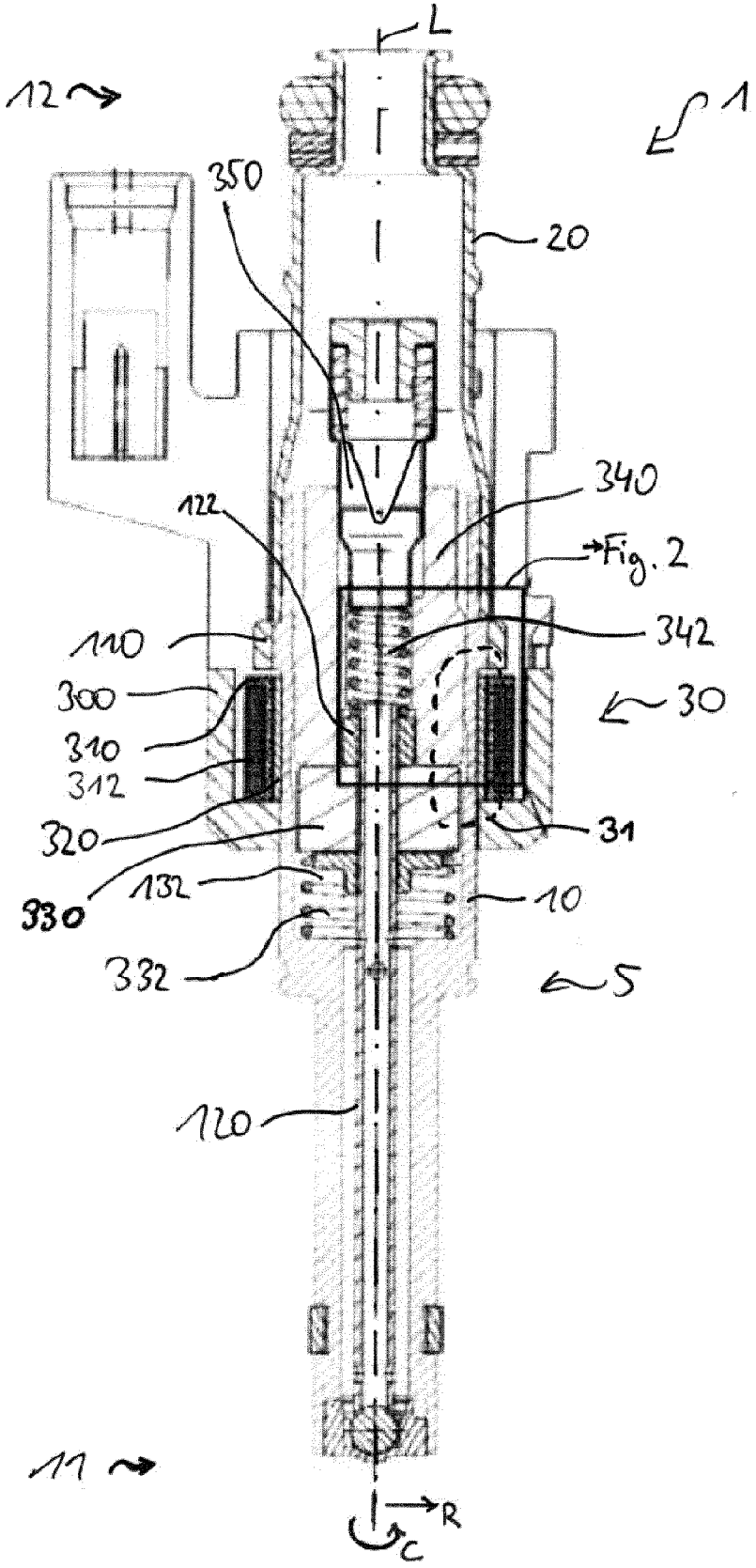
FIG. 1 shows an example embodiment of a fluid injector in a longitudinal sectional view.

Embodiments of the invention provide a valve body for a fluid injector having particularly good magnetic and mechanical properties.

A valve body for a fluid injector is specified according to one aspect. The valve body is sometimes also referred to as a nozzle body or as an injector body. A fluid injector comprising the valve body is specified according to another aspect.

The valve body comprises a base body. The base body is a one-pieced part. In other words, the base body in particular extends in one piece from a fluid inlet end of the valve body to a fluid outlet end of the valve body. The base body is in particular not assembled from a plurality of individual elements. The base body has a side wall which defines a recess, the recess extending from a fluid inlet side to a fluid outlet side of the base body, i.e. in particular from the fluid inlet end of the valve body to the fluid outlet end of the valve body.

The side wall has a thin portion. The thin portion has a decreased wall thickness as compared to further portions of the side wall, which further portions adjoin the thin portion in longitudinal direction towards the fluid inlet end and towards the fluid outlet end, respectively.

The valve body comprises a reinforcement jacket which is rigidly coupled to the base body and axially overlaps the thin portion having the decreased wall thickness. In one embodiment, the reinforcement jacket covers the thin portion over a full longitudinal extension of the thin portion. The base body and the reinforcement jacket each are preferably made from a metal or an alloy; for example they are made from steel of different steel grades.

In one embodiment, the reinforcement jacket comprises a paramagnetic or non-magnetic material, the material being in particular a steel. Preferably, the whole reinforcement jacket is made from the paramagnetic or non-magnetic material. In one embodiment, the base body is at least partially made from a ferromagnetic material. In one embodiment, the base body consists of the ferromagnetic material, in particular of a ferromagnetic steel.

The fluid injector may comprise an actuator assembly, preferably an electromagnetic actuator assembly which comprises an electromagnetic coil. The base body may be provided for carrying the electromagnetic coil.

With advantage, the presence of the thin portion—by means of its partially decreased wall thickness—may result in a particularly low parasitic magnetic flux through the base body in longitudinal direction. At the same time, since the base body carries the reinforcement jacket essentially at a longitudinal height of the thin portion, the valve body has a good mechanical stability.

In one embodiment, the reinforcement jacket is welded to the valve body.

In another embodiment, the dimensions of the reinforcement jacket are chosen in such a way that the jacket, after mounting of the reinforcement jacket to the base body, exerts compressive mechanical stress on the base body in radially inward direction. "Radially inward direction" in the present context means in particular any direction which is perpendicular to the longitudinal axis and is directed towards the longitudinal axis. In this way, a particularly high mechanical stability of the valve body—in particular with respect of high fluid pressure inside the recess of the base body—is achievable in the region of the thin portion.

The reinforcement jacket may be hooped or press-fitted to the base body. In this way, the compressive mechanical stress on the base body is well achievable. In one development, the reinforcement jacket is additionally welded to the base body. In this way, a particularly high resistance of the valve body against stress in the longitudinal direction is achievable.

In one embodiment, the jacket extends further at the base body than the decreased wall thickness in the base body at one or both longitudinal ends or end sections of the reinforcement jacket. In other words, the reinforcement jacket projects beyond the thin portion in longitudinal direction towards the fluid inlet side and/or towards the fluid outlet side. In this way, the mechanical stability of the valve body may be further improved.

The thin portion may be positioned in a longitudinal middle section of the reinforcement jacket or in a longitudinal end section of the reinforcement jacket, the longitudinal end section facing the fluid outlet side or the fluid inlet side, respectively, of the base body. The fluid outlet side of the base body is downstream and the fluid inlet side is upstream of the thin portion. In one embodiment, the thin portion of the valve body is formed by means of a circumferential groove in the base body.

The groove may be comprised by an inner circumferential surface of the side wall of the base body. The reinforcement jacket may adjoin an outer circumferential side surface of the side wall. In this way, the reinforcement jacket may have a smooth inner surface—i.e. a surface without steps or kinks—which abuts the base body over the complete longitudinal extension of the reinforcement jacket. The compressive stress exerted on the base body by the reinforcement jacket may be particularly homogenously distributed in this way.

In one embodiment, the thin portion of the base body represents an at least a partially circumferential portion of the base body. Preferably, the thin portion extends completely circumferentially around the longitudinal axis of the base body.

Furthermore, the thin portion extends in the longitudinal direction of the base body. Here, a length, i.e. the longitudinal dimension, of the thin portion—for example corresponding to the longitudinal dimension of the groove—may be a multiple of its thickness. The reinforcement jacket may cover a full circumferential extension of the thin portion. Expediently, the reinforcement jacket may extend completely circumferentially around the base body.

In an expedient embodiment of the fluid injector, the electromagnetic actuator assembly comprises the electromagnetic coil, an armature and a pole piece. It may further comprise a housing and/or a washer. The pole piece—together with the housing and/or the washer—may make part of a yoke or may represent a yoke of an electromagnetic circuit of the actuator.

The fluid injector may, in one embodiment, comprise an inlet tube or a second valve body. The inlet tube may expediently be hydraulically coupled to the valve body. Fluid may flow from the fluid inlet side through the inlet tube and further through the recess of the valve body to the fluid outlet side for being dispensed from the fluid injector.

The housing of the electromagnetic actuator and/or injector is in particular magnetically connected to the electromagnetic coil. The armature may expediently be moveable in a reciprocating manner in the base body and is in particular magnetically connected to the housing the base body. The pole piece, the inlet tube or valve body is in particular magnetically connected to the armature. Additionally, the washer may be mounted on the base body and is in particular magnetically connected to the pole piece, the inlet tube or the second valve body via the base body.

In one embodiment, a bobbin which is provided with the electromagnetic coil is mounted on the outside of the valve body. The reinforcement jacket may be provided between the base body and the bobbin. The bobbin may be distanced from the base body in longitudinal direction, in particular at a longitudinal end of the reinforcement jacket. In this way, a particularly low parasitic magnetic flux through the base body is achievable.

Furthermore, at a longitudinal end or end section of the reinforcement jacket, a gap, particularly an air gap, may be provided between the electromagnetic coil or bobbin and the base body. The gap may extend in radial direction. The gap extends in longitudinal direction wherein furthermore two such radial gaps at opposite longitudinal ends or end sections of the reinforcement jacket may be provided. Here, the radial (and longitudinal) gap may fully circulate around the longitudinal direction.

The base body, having a reduced thickness in the region of the thin portion, allows for decreasing or minimising the magnetic flux bypass through the base body because of a bottle neck for the magnetic flux which is introduced by means of the decreased wall thickness, preferably the groove. The preferably external reinforcement jacket, particularly shrunk on the base body, compresses the base body so that a mechanical stress in the base body is overcome before a tension caused by high fluid pressure inside the injector may have a weakening effect on or in the base body, in particular in the region of the thin portion which is mechanically comparatively weak due to its reduced thickness. Thus, a capacity of the base body to resist an inside fluid pressure is increased by means of the reinforcement jacket. However, the reinforcement jacket preferably does not contribute to or only weakly contributes to the parasitic magnetic flux. With the valve body according to the present disclosure, the fluid injector may be operated at very high fluid pressures without losing an overall efficiency of its magnetic circuit and with fast dynamic responses.

Figure 2:
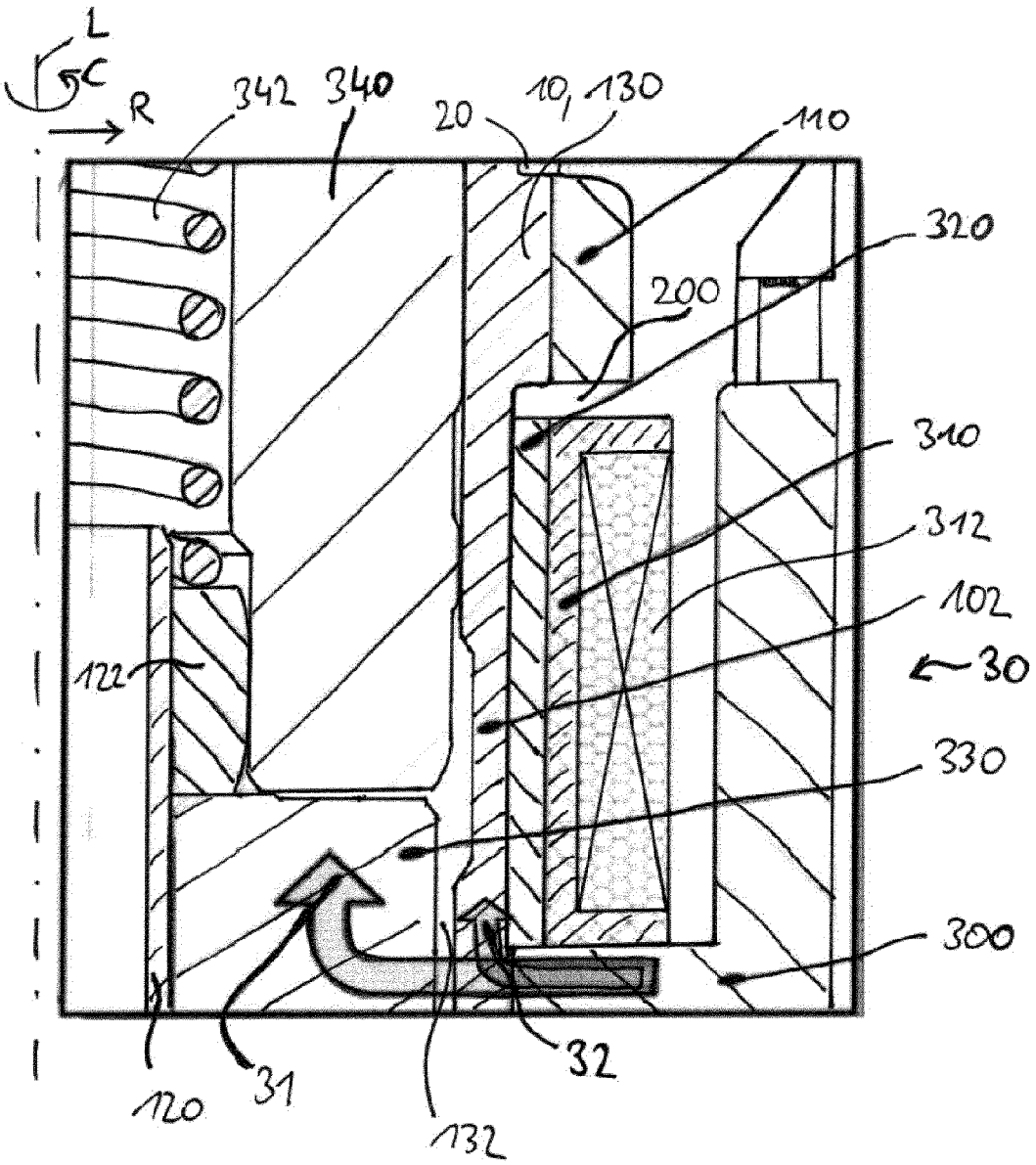
FIG. 2 shows an enlarged and detailed portion of the longitudinal sectional view of FIG. 1.

FIG. 1 shows a fluid injector 1 in a longitudinal cross-section. FIG. 2 shows a portion of the fluid injector 1 in an enlarged, detailed cross-sectional view. The portion shown in FIG. 2 is roughly indicated by a box in FIG. 1.

The fluid injector of the present embodiment is provided for dosing gasoline into an intake manifold (not shown in the figures) or directly into a combustion chamber of an internal combustion engine (also not shown in the figures) of a motor vehicle.

In a variant (not shown in the figures), the fluid injector 1 may be a diesel injection nozzle of a common-rail injection system. While the present injector 1 is designed to inject a fuel, it is also conceivable to inject another kind of fluid such as water, oil, an aqueous urea solution or another process liquid.

Figure 3:
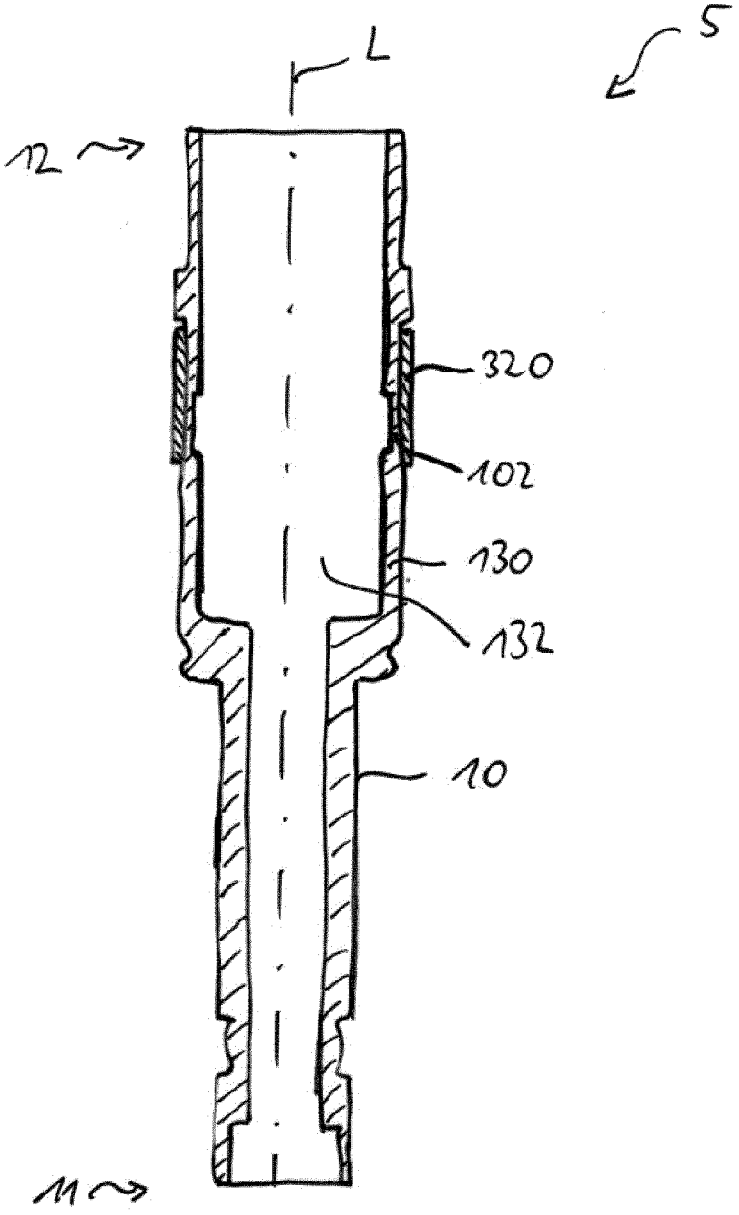
FIG. 3 shows a valve body of the fluid injector in a longitudinal sectional view.

The fluid injector 1 comprises a valve body 5. The valve body 5 is shown in a cross-sectional view in FIG. 3.

The fluid injector 1 further comprises an inlet tube 20 or second valve body 20. The fluid injector 1 further comprises an outer housing 300 arranged around the valve body 5. Here, the outer housing 300 is in particular partially arranged at the valve body 5 and partially arranged at the inlet tube 20.

The valve body 5 has a central longitudinal axis L, defining a longitudinal direction. Further, an (outward) radial direction R and a circumferential direction C are indicated in the figures.

The valve body 5 comprises a one-pieced, ferromagnetic base body 10. The base body 10 has a side wall 130 defining a recess 132 extending from a fluid inlet side 12 to a fluid outlet side 11 of the base body 10. The fluid inlet side 12 of the base body is also a fluid inlet end of the valve body 5 and the fluid outlet side 11 of the base body is also a fluid outlet end of the valve body 5. Expediently, during operation of the fluid injector 1, fluid is flowing through the recess 132 from the fluid inlet side 12 to the fluid outlet side 11 for dispensing fluid from the fluid injector 1 at the fluid outlet side 11.

The outer housing 300 houses a bobbin 310 which is provided with an electromagnetic coil 312 of an electromagnetic actuator assembly 30 (see below) of the fluid injector 1. The outer housing 300 constitutes a part, particularly a part of a yoke, of an electromagnetic circuit (cf. below) of the actuator assembly 30. The electromagnetic circuit in the present case further comprises an armature 330, a pole piece 340 and a washer 110. The pole piece 340 of the present embodiment is a separate piece which is rigidly coupled to the base body 10 and received in the recess 132. It may also be in one piece with the inlet tube 20 in another embodiment.

The housing 300 (preferably as a yoke), the base body 10, the armature 330, the pole piece 340 (inlet tube 20), the base body 10 again and an optional washer 110 (preferably as a yoke) mounted at the base body 10 in the present case form the electromagnetic circuit of the injection valve 1 (see FIG. 2). Different arrangements of the electromagnetic actuator 30 and/or the electromagnetic circuit are also conceivable.

A valve needle 120 and the armature 330 of the electromagnetic actuator assembly 30 are arranged in the recess 132. The needle 120 and the armature 330 are moveable in a reciprocating manner in longitudinal direction L with respect to the valve body 5.

In a closed position of the needle 120, it abuts on a seat of the fluid injector 1 in a sealing manner, thereby preventing fuel from flowing through the fuel outlet side 11 of the fluid injector 1. The seat may be in one piece with the base body 10 or it may be rigidly coupled to the base body 10. It is expediently arranged at the fluid outlet side 11 and in particular occludes the recess 132 at the fluid outlet side 11.

A main spring 342 is arranged in the recess 132, in particular in a central opening of the inlet tube 20 and/or of the pole piece 340. The main spring 342 is mechanically coupled to the needle 120 and operable to move the needle 120 in longitudinal direction L towards the fluid outlet side 11 into its closed position. A filter element 350 is arranged in central opening of the inlet tube 20 and/or the pole piece 340 and forms a further seat for the main spring 342. The main spring 342 is pre-loaded by means of the filter element 350 for biasing the needle 120 towards the seat.

The armature 330 is mechanically coupled to the valve needle 120 so that is operable to displace the valve needle 120 in longitudinal direction towards the fluid inlet side 12 against the bias of the main spring 342. In this way, the valve needle 120 is axially movable away from the closed position to an opened position by means of a longitudinal displacement of the armature 330 in the same direction. In the opened position of the needle 120, to which the needle 120 is moved against the bias of the main spring 342 via mechanical interaction with the armature 330 when the actuator assembly 30 is energized, fuel may be injected through the fluid outlet side 11. The fluid outlet side 11 is in fluid communication with the fuel inlet or upstream side 12 of the injection valve 1 or base body 10.

Specifically, for mechanically coupling to the armature 330, the needle 120 comprises a guide 122 which is arranged longitudinally adjacent to the armature 330 and is preferably formed as a collar or sleeve of the needle 120. The guide 122 is preferably positioned near an upstream end of the needle 120. The guide 122 may be a separate piece which is fixedly coupled to a barrel of the needle 120 as in the present exemplary embodiment. Alternatively, the needle 120 with the guide 122 may be in one piece. The guide 122 preferably is in mechanical contact with an inner side of the central opening of the pole piece 340 for guiding the needle 120 in longitudinal direction L.

In the present embodiment, the armature 330 and the needle 120 are longitudinally displaceable relative each other so that it can decouple from the guide 122 and slide along the barrel of the needle 120 when the needle 120 hits the seat. The kinetic energy of the armature 330 may be absorbed by an armature spring 332 downstream of the armature 330. Here, the armature spring 332 is preferably accommodated in the recess 132, as well. Also, the needle 120 can move axially with respect to the armature 330 when the latter hits the pole piece 340 so that the kinetic energy of the needle can be absorbed by the main spring 342. In an alternative embodiment, the armature 330 may be rigidly coupled to the needle 120.

Hereinafter, the function of the fluid injector 1 is described. Fuel is led through the inlet tube 20 into the recess 132 via the filter element 350 and towards the fluid outlet side 11. When the coil 312 of the electromagnetic actuator assembly 30 is energised, an electromagnetic force on the armature 330 is effected. The armature 330 is magnetically attracted by the pole piece 340 and moves away from the fluid outlet side 11 in longitudinal direction L. The armature 22 takes the needle 120 with it by means of mechanical interaction with the guide 122 so that the needle 120 moves in longitudinal direction L out of its closed position to the opened position. In this way, a fuel path is formed between the needle 120 and its seat, and fuel is dispensed from the fluid injector 1 through the seat at the fluid outlet side 11.

When the electromagnetic actuator assembly 30 is deenergised, the main spring 342 forces the needle 120 to move in longitudinal direction L into its closed position. When the needle 120 reaches its closed position, the armature 330 decouples from the guide 122. The movement of the armature 330 is dampened by the armature spring 332. Longitudinal displacement of the armature 330 with respect to the valve needle 120 towards the fluid outlet side 11 may be limited by a stop element. In the present embodiment, the stop element is fixed to the barrel of the needle 120 downstream of the armature 330.

Since the base body 10 is made from a ferromagnetic material, a magnetic flux 31, 32 of the magnetic circuit is bifurcated into a desirable primary flux 31 and an undesirable secondary flux 32, which may also be called a parasitic flux or a flux bypass (see FIG. 2). The flux bypass 32 deteriorates the dynamic responses of the injection valve 1. In view of the ferromagneticity of the base body 10, the flux bypass 32 through the base body 10, e. g. in longitudinal direction L through its sidewall 130, should be as small as possible for obtaining an injection valve 1 having good dynamic responses.

The sidewall 130 of the base body 10 has a thin portion 102 which has a decreased wall thickness for achieving—with advantage—a particularly small flux bypass 32 in longitudinal direction L through the base body 10. Advantageously, the thin portion 102 leaves the primary flux 31 in radial direction R essentially unaffected. The locally decreased wall thickness of the thin portion 102 of the base body 10 may create a bottle neck for the magnetic flux through the side wall 130 which is able to reduce the magnetic flux bypass 32 by magnetic saturation.

Further, the valve body 5 comprises a paramagnetic or non-magnetic reinforcement jacket 320 at a longitudinal height of the thin portion 102 of the base body 10. With advantage, the reinforcement jacket 320 mechanically stabilizes the valve body 5 in the region of the thin portion 102—where the structural resistance of the base body 10 would otherwise be impaired due to the reduced wall thickness—without significantly increasing the parasitic magnetic flux 32. In this way, the fluid injector 1 has a particularly high magnetic efficiency. At the same time, it can be operated at particularly high fuel pressures, in particular at fuel pressures which would damage the base body 10 in the region of the thin portion 102 without the reinforcement jacket 320.

The thin portion 102 is formed by means of a groove in an inner surface of the side wall 130 in the present embodiment. The "inner surface" of the side wall 130 is the surface facing the longitudinal axis L in the present context.

In order to compensate the weakening of the base body 10 by means of the groove, the reinforcement jacket 320, for example a paramagnetic tube 320, is shrunk on the base body 10. In some embodiments, it is possible to provide the reinforcement jacket 320 inside of the base body 10 (not shown). Preferably, the reinforcement jacket 320 is provided outside of the base body 10, in particular at a radial side of the base body 10 opposite of the side which is provided with the groove. In the present embodiment, the reinforcement jacket 320 is provided on an outer surface, facing away from the longitudinal axis L, of the base body 10.

The base body 10 and the jacket 320 lie, preferably over essentially the entire length and circumference of the jacket 320, closely spaced against each other, i.e. in a tightly fitting manner. The dimensions of the jacket 320 may be selected such that it exerts a radial mechanical force on the base body 10. In particular, the jacket 320 produces compression in the base body 10 in radially inward direction and thus enables the base body 10 to carry higher fuel pressures. The reinforcement jacket 320 acts as an enhancement of the wall thickness of the base body 10 without allowing a high flux bypass 32.

The thin portion 102 preferably runs around the longitudinal axis L at the same longitudinal height as the reinforcement jacket 320 and preferably covers a full circumferential C extension. A dimension of the thin portion 102 in longitudinal direction L is preferably a multiple of its thickness in radial direction R.

Preferably, the reinforcement jacket 320 is made from a metal or an alloy, wherein induction heating of the jacket 320 may be used for its assembly to the base body 10 in order to limit a maximum required force as well as a deformation; the jacket 320 is hooped on the base body 10. In addition, the jacket 320 may be constructed as a press-fit bush, wherein in a mounting position of the jacket 320 on the base body 10, a surface pressure is exerted onto the base body 10 by the jacket 320. I. e. the jacket 320 may be transition- or press-fitted to the base body 10. Moreover, the jacket 320 may be connected to the base body 10 by means of welding to achieve a better resistance to a longitudinal stress and to block the housing 300 in position.

Preferably, the reinforcement jacket 320 extends further into the mounting position at the base body 10 than the groove 102 in the base body 10, particularly in both longitudinal directions L at the base body 10. Here, a free end of the jacket 320, which faces the outlet side 11 of the base body 10 may be arranged closer to the groove 102 in longitudinal direction L than the opposite free end of the jacket 320, which faces the inlet side 12 of the base body 10 (see FIG. 2). This may be inversely arranged (not shown). Furthermore, the reinforcement jacket 320 may longitudinally extend as long as the bobbin 320 or coil 312 in longitudinal direction L at the base body 10. Moreover, the jacket 320 may be longer (not shown) or shorter (cf. dotted line in FIG. 2) than the bobbin 320 or coil 312.

As shown in the figures, the reinforcement jacket 320 and the groove defining thin portion 102 of the base body 10 are arranged on different sides of the base body 10. Thereby, it is preferred that the jacket 320 is arranged outside of the base body 10, and the decreased wall thickness 102 is arranged inside of the base body 10. It is preferred that there is very little space (cf. above) left between an outer surface of the base body 10 and an inner surface of the jacket 320, preferably as little space as possible, wherein the base body 10 and the reinforcement jacket 320 preferably constitute a compound part, particularly a pressed compound part. Furthermore, the base body 10 and the reinforcement jacket 320 each constitute a part of the valve body 5.

What is claimed is:

1. A valve body for a fluid injector, the valve body comprising:

a central longitudinal axis; and a base body comprising a ferromagnetic material and having a side wall defining a recess extending from a fluid inlet end of the valve body to a fluid outlet end of the valve body, the recess having an inner side wall surface with a base inner diameter and an outer side wall surface;

wherein the side wall has a thin portion having a decreased wall thickness relative to further portions of the side wall on both sides of the thin portion along the central longitudinal axis, wherein the outer side wall surface of the side wall in the thin portion comprises a smooth cylindrical surface;

a circumferential groove in the base body from the base inner diameter to a larger groove diameter, wherein the circumferential groove defines the decreased wall thickness of the thin portion, wherein the valve body comprises a metallic reinforcement jacket comprising a paramagnetic or a non-magnetic material and having a length along the central longitudinal axis, rigidly coupled to the smooth cylindrical outer side wall surface of the base body and which axially overlaps and extends beyond the thin portion having the decreased wall thickness, the reinforcement jacket includes a smooth inner surface without steps or kinks and the smooth inner surface of the reinforcement jacket is in direct physical contact with the smooth cylindrical outer side wall surface of the base body along the full length of the metallic reinforcement jacket.

2. The valve body of claim 1, wherein the reinforcement jacket is coupled to the base body by at least one of a hooped connection, a press-fit connection, or a welded connection.

3. The valve body of claim 1, wherein the reinforcement jacket is dimensioned such that the reinforcement jacket exerts compressive mechanical stress on the base body in a radially inward direction.

4. The valve body of claim 1, wherein the reinforcement jacket covers the thin portion over a full longitudinal length of the thin portion.

5. The valve body of claim 1, wherein the thin portion is positioned in a longitudinal middle section of the reinforcement jacket.

6. A fluid injector, comprising:

a valve body comprising:

a central longitudinal axis; and a base body comprising a ferromagnetic material and having a side wall defining a recess extending from a fluid inlet end of the valve body to a fluid outlet end of the valve body, the recess having an inner side wall surface with a base inner diameter and an outer side wall surface;

an electromagnetic actuator assembly, comprising an electromagnetic coil, and a bobbin mounted outside of the valve body;

wherein the side wall has a thin portion having a decreased wall thickness relative to further portions of the side wall on both sides of the thin portion along the central longitudinal axis, wherein the outer side wall surface of the sidewall in the thin portion comprises a smooth cylindrical surface, the recess having a larger inner diameter in the region of the thin portion of the side wall and a matching outer diameter in the region of the thin portion of the side wall and the further portions of the side wall; and wherein the valve body comprises a metallic reinforcement jacket comprising a paramagnetic or a non-magnetic material that is rigidly coupled to the smooth cylindrical outer side wall surface of the base body and which axially overlaps and extends beyond the thin portion having the decreased wall thickness, and wherein the reinforcement jacket having a length along the central longitudinal axis and arranged between the base body and the bobbin;

wherein the electromagnetic actuator assembly forms an electromagnetic circuit comprising:

the base body, the electromagnetic coil, an armature, wherein the armature is moveable in a reciprocating manner in the base body, and a pole piece, and wherein the reinforcement jacket includes a smooth inner surface without steps or kinks which adjoins the smooth cylindrical outer side wall surface in the area of the thin portion so the metallic reinforcement jacket exerts a compressive mechanical stress on the base body in a radially inward direction in the region of the thin portion, and the reinforcement jacket axially overlaps with at least one of the armature or the pole piece and the smooth inner surface of the reinforcement jacket is in direct physical contact with the smooth cylindrical outer side wall surface of the base body along the full length of the metallic reinforcement jacket.

7. The fluid injector of claim 6, wherein at a longitudinal end of the reinforcement jacket, the bobbin is spaced apart from the base body along a longitudinal direction.

8. The fluid injector of claim 6, wherein the valve body comprises a circumferential groove in the base body, wherein the circumferential groove defines the decreased wall thickness of the thin portion.

9. The fluid injector of claim 8, wherein the groove defines an inner circumferential surface of the side wall.

10. The fluid injector of claim 6, wherein the reinforcement jacket covers the thin portion over a full longitudinal length of the thin portion.

11. The fluid injector of claim 6, wherein the reinforcement jacket projects beyond the thin portion in a longitudinal direction towards at least one of the fluid inlet side or the fluid outlet side.

12. The valve body of claim 1, wherein the thin portion is positioned in either a longitudinal end section of the reinforcement jacket that faces the outlet side of the base body or a longitudinal end section of the reinforcement jacket that faces the inlet side of the base body.

13. A valve body for a fluid injector, the valve body comprising:

a central longitudinal axis; and a base body having a side wall defining a recess extending from a fluid inlet end of the valve body to a fluid outlet end of the valve body, the recess having an inner side wall surface with a base inner diameter and an outer side wall surface;

wherein the side wall has a thin portion having a decreased wall thickness relative to further portions of the side wall on both sides of the thin portion along the central longitudinal axis, wherein the outer side wall surface of the side wall in the thin portion comprises a smooth cylindrical surface;

a circumferential groove in the base body from the base inner diameter to a larger groove diameter, wherein the circumferential groove defines the decreased wall thickness of the thin portion;

wherein the valve body comprises a metallic reinforcement jacket that is rigidly coupled to the smooth cylindrical outer side wall surface of the base body and which axially overlaps and extends beyond the thin portion having the decreased wall thickness;

the reinforcement jacket includes a smooth inner surface without steps or kinks;

the reinforcement jacket comprises a paramagnetic or a non-magnetic material; and the base body comprises a ferromagnetic material.

* * * * *